United States Patent [19]

Fröhlich

[11] Patent Number: 5,048,264

[45] Date of Patent: Sep. 17, 1991

[54] PROCESS AND APPARATUS FOR THE TEMPORARY STORAGE OF MULTI-SHEETED, FOLDED PRINTING PRODUCTS, SUCH AS NEWSPAPERS, PERIODICALS AND PARTS THEREOF

[75] Inventor: Beat Fröhlich, Oberdürnten, Switzerland

[73] Assignee: Ferag AG, Switzerland

[21] Appl. No.: 478,557

[22] Filed: Feb. 12, 1990

[30] Foreign Application Priority Data

Feb. 22, 1989 [CH] Switzerland ..... 00640/89

[51] Int. Cl.[5] ..... B65B 63/04; B65H 29/66

[52] U.S. Cl. ..... 53/430; 53/118; 53/399; 53/587

[58] Field of Search ..... 53/430, 118, 117, 116, 53/399, 587; 242/67.1 R, 59

[56] References Cited

U.S. PATENT DOCUMENTS

| | | | |
|---|---|---|---|
| 4,438,618 | 3/1984 | Honegger | 53/430 |
| 4,538,397 | 9/1985 | Boss | 53/118 X |
| 4,637,198 | 1/1987 | Gerber | 53/430 |
| 4,694,959 | 9/1987 | Ausnit et al. | 53/118 X |
| 4,832,273 | 5/1989 | Honegger | 53/118 X |
| 4,871,125 | 10/1989 | Haueter | 53/430 X |

FOREIGN PATENT DOCUMENTS

| | | |
|---|---|---|
| 1244495 | 8/1988 | Canada . |
| 183013 | 6/1986 | European Pat. Off. . |
| 35952 | 2/1935 | Netherlands . |
| 2119768 | 11/1983 | United Kingdom . |

*Primary Examiner*—James F. Coan

*Attorney, Agent, or Firm*—Oliff & Berridge

[57] ABSTRACT

The present invention involves methods and apparatus for winding imbricated formations of multi-sheeted, twice-folded printing products into a roll together with a winding band wherein the individual multi-sheeted, twice-folded printing products are skewed in relation to the conveying direction of the imbricated formation by a small angle. The laterally protruding corners of the printing products lie on imaginary straight lines which run parallel to the conveying direction. The lateral fold edges of the printing products are mutually offset by a certain amount in a direction running transversely to the conveying direction. The lateral fold edges therefore do not end up one on top of the other during winding, as a result of which a thickening on one side of the roll is avoided.

33 Claims, 3 Drawing Sheets

Fig.1
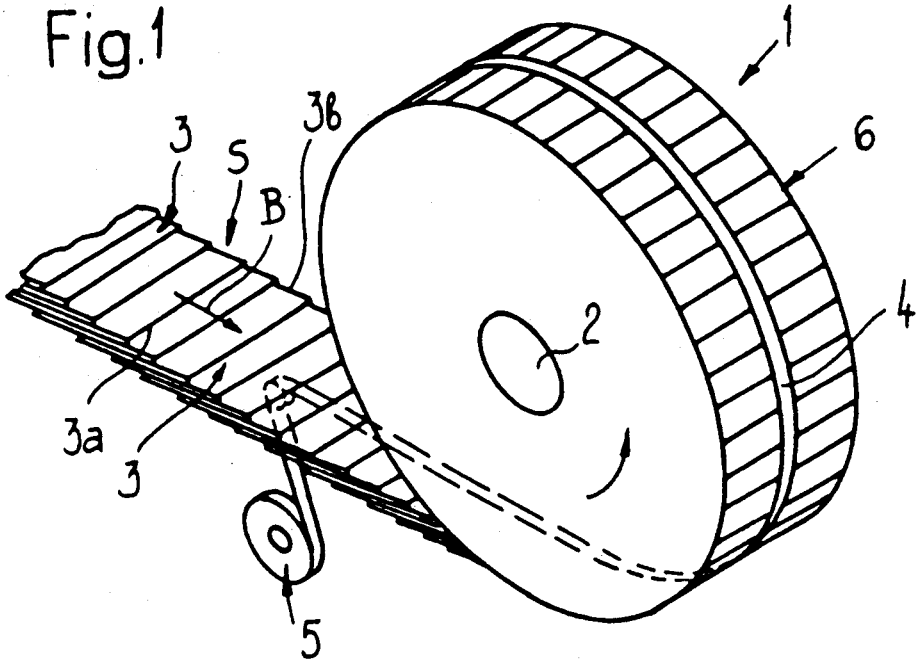
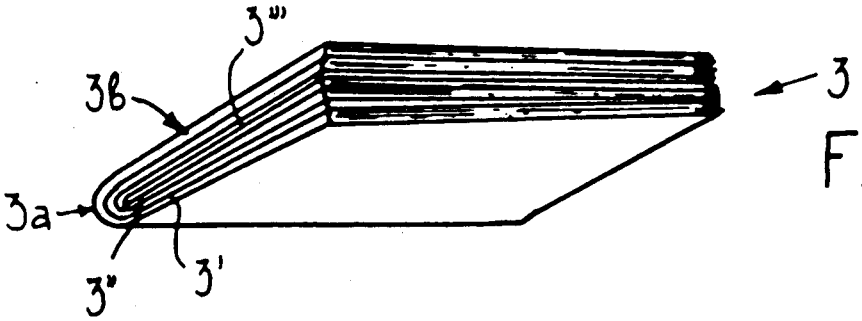
Fig.2
Fig.3
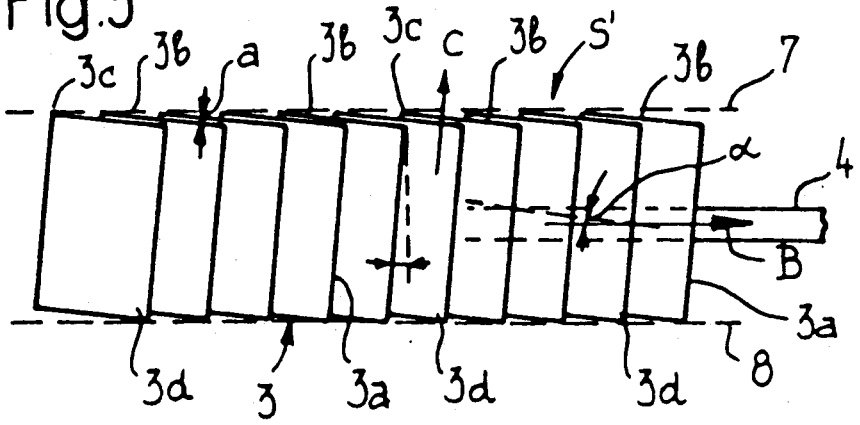

Fig. 4
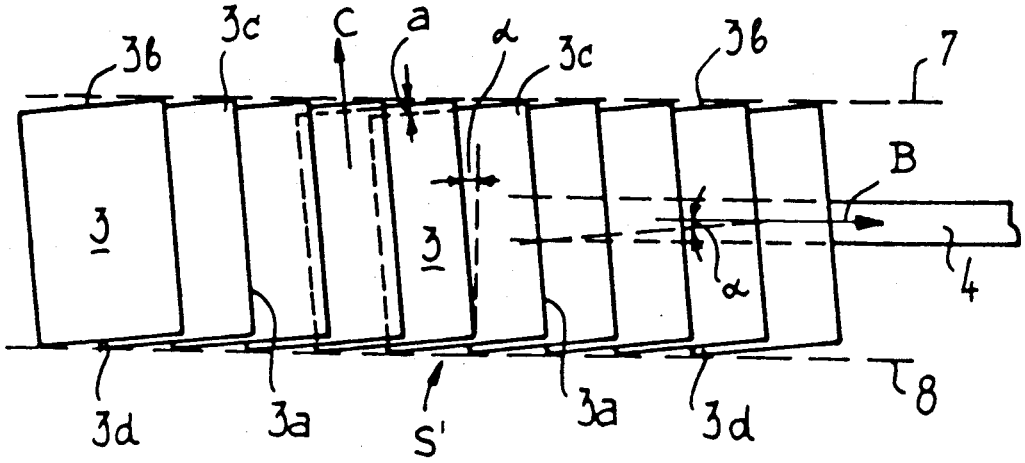
Fig. 5
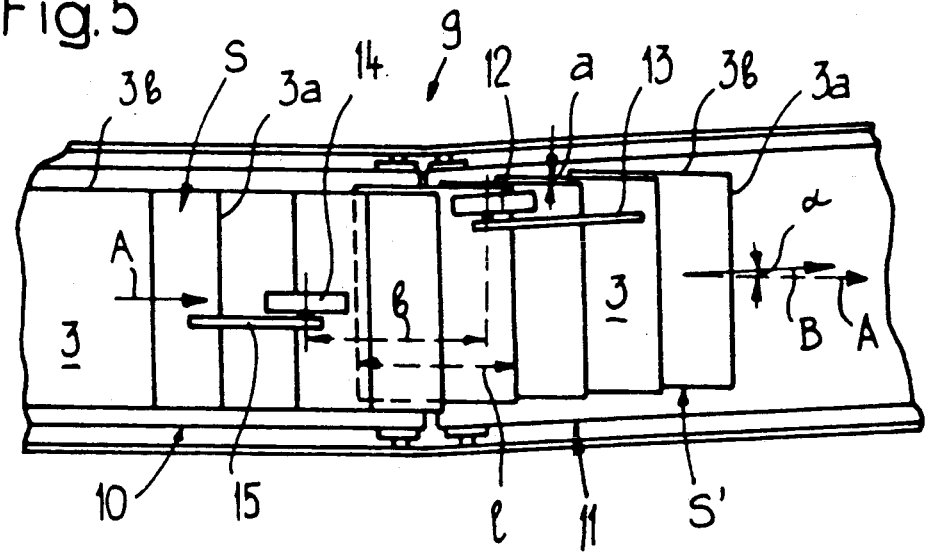
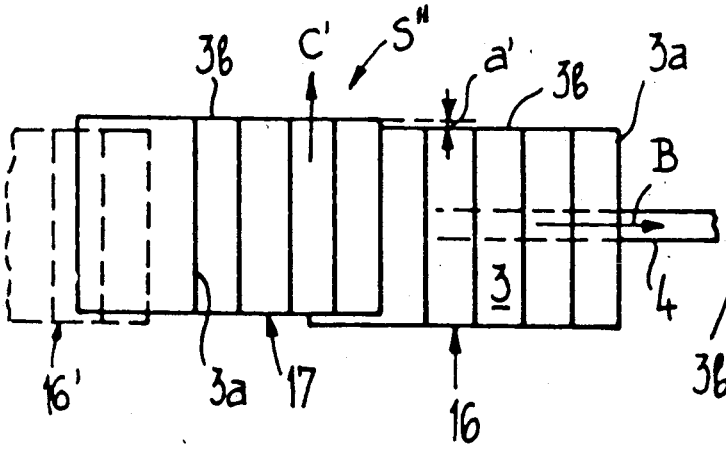
Fig. 6
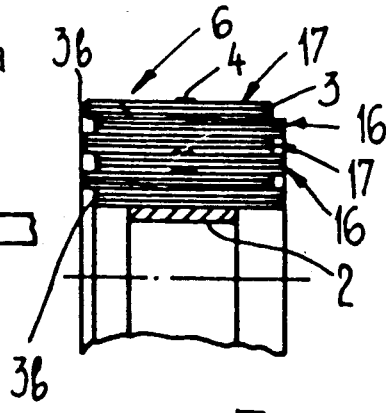
Fig. 7

PROCESS AND APPARATUS FOR THE TEMPORARY STORAGE OF MULTI-SHEETED, FOLDED PRINTING PRODUCTS, SUCH AS NEWSPAPERS, PERIODICALS AND PARTS THEREOF

BACKGROUND OF THE INVENTION

1. Field of the Invention

The present invention relates to a process and an apparatus for the temporary storage of multi-sheeted, folded printing products, such as newspapers, periodicals and parts thereof and particularly to a process and apparatus for the temporary storage of such multi-sheeted, folded printing products which arrive at a winding location in an imbricated formation with a fold edge at one side.

2. Description of Related Art

A process and an arrangement whereby multi-sheeted, folded printing products arrive at a winding location in an imbricated formation with a fold edge at one side are known from German Patent Specification 3,123,888 and corresponding U.S. Pat. No. 4,438,618. Twice-folded printing products are fed to a winding core, or a roll forming on the winding core, with their lateral fold edges aligned with one another in the conveying direction and are wound up together with the winding band ending up on the outside of the roll. As a consequence of this arrangement, the lateral fold edges lie on top of each other and cause a considerable increase in the roll radius on one side of the roll. This one-sided increase in radius is disadvantageously noticeable in the case of thick printing products and/or rolls of large diameter. When this one-sided increase in radius occurs, the circumference of the roll no longer essentially forms a cylindrical surface but instead resembles the outer surface of a truncated circular cone. A consequence of this situation is that the winding band moves sideways out of the central position on the roll and, as a result, the degree to which the printing products are held together in a roll is reduced considerably or even lost.

OBJECTS AND SUMMARY OF THE INVENTION

An object of the present invention is to provide a process and an apparatus whereby multi-sheeted, folded printing products arrive at a winding location in an imbricated formation with a fold edge at one side which permits even thick, folded printing products to be wound, with a folding edge at one side, into intrinsically stable rolls of large diameter without requiring the actual winding operation to be adapted, that is, without the tensile force applied to the winding band and the central guidance of the winding band needing to be changed.

This object is achieved according to the present invention by winding at least some of the printing products with their lateral fold edge slightly offset in relation to the lateral fold edge of a neighboring printing product in a direction which runs transversely to the conveying direction of the imbricated stream of printing products. By feeding the printing products in a formation in which all or some of the printing products have their lateral fold edges offset in relation to the lateral fold edges of neighboring printing products in a direction running transversely to the conveying direction, not all of the lateral fold edges end up on top of one another in the roll. Thus, an undesired thickening on one side edge of the roll is avoided. Even in the case of thick printing products and large diameter rolls, the rolls are even enough for them to be wound compactly without it being necessary to increase the tensile stress in the winding band or to offset the winding band outwardly from the center of the roll. The present invention permits printing products without a lateral fold edge and products with a lateral fold edge to be wound up in the same way, with the same apparatus.

BRIEF DESCRIPTION OF THE DRAWINGS

Exemplary embodiments of the process according to the invention and of the apparatus according to the invention are described below with reference to the drawings, in which:

FIG. 1 is a perspective, simplified view of a winding station;

FIG. 2 is a perspective view of a multi-part, twice-folded printing product;

FIGS. 3 and 4 are plan views of various formations in which the printing products are slightly skewed in relation to their conveying direction;

FIG. 5 is a plan view of an apparatus for forming the formation shown in FIG. 3;

FIG. 6 is a plan view of a formation in which a group of printing products is laterally offset in relation to a group of preceding printing products;

FIG. 7 is a sectional view of a part of a roll formed by winding of the imbricated formation according to FIG. 6.

DETAILED DESCRIPTION OF THE PREFERRED EMBODIMENT

Figure 8:
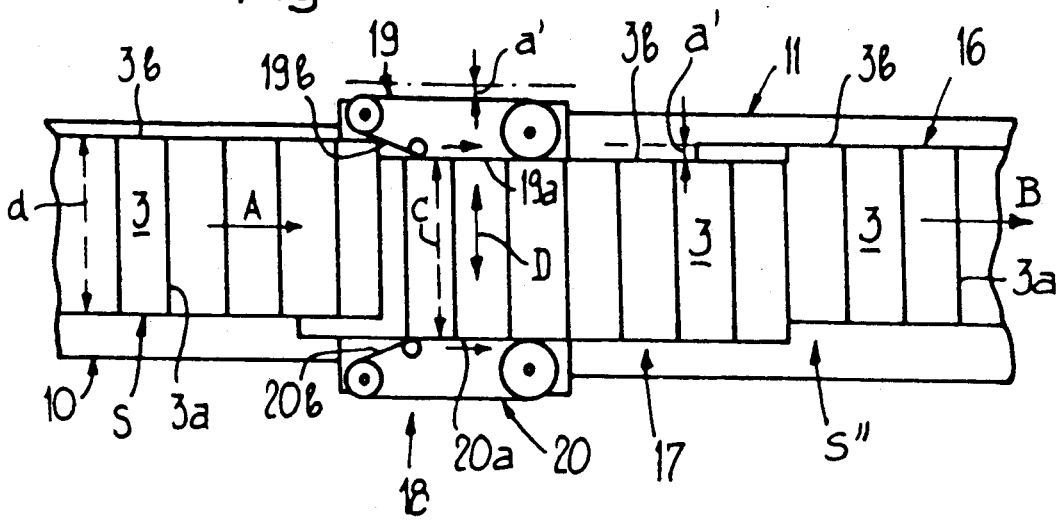
FIGS. 8–10 illustrate various apparatus for the forming of imbricated formations of the type shown in FIG. 6.

The design of a winding station will be explained with reference to FIG. 1. The winding station 1, which is shown simplified in FIG. 1 and corresponds to the winding station described in German Patent Specification 3,123,888 and corresponding U.S. Pat. No. 4,438,618, has a winding core 2, rotatably mounted to structure not shown. By means of a conveying device (not shown), winding core 2 is fed with twice-folded printing products 3 in an imbricated formation S in the direction of the arrow B. The printing products 3, which may be newspapers, periodicals or parts thereof, lie one on top of the other in an imbricated manner, each printing product 3 partially overlapping the preceding product in the exemplary embodiment shown. In this case, the leading edge 3*a* is formed by one of the fold edges, while the other fold edge 3*b* is at the side of the printing product. In the winding station 1, this imbricated formation S is then wound onto the winding core 2 together with a winding band 4. In this case, the winding band 4 is drawn off from a supply reel 5. The forming of the roll 6 is described in more detail in the two patent specifications cited above.

An example of a printing product 3 to be wound according to the present invention is shown in FIG. 2. Printing product 3 consists of three parts 3', 3'' and 3''', inserted one in the other. These parts are multi-sheeted and twice-folded. The transversely running fold edges 3*a* of all the parts 3', 3'' and 3''' lie against one another, while the lateral fold edges 3*b* of all these parts are arranged on the same side of the product 3.

To avoid a thickening of one side of the roll 6 during the winding of an imbricated formation S formed from such printing products 3 on account of the lateral fold edges 3*b* lying one on top of the other, the printing products 3 are wound in a formation in which, according to the present invention, the lateral fold edges 3*b* of at least some of the printing products 3 are slightly offset in relation to the lateral fold edges 3*b* of neighboring printing products 3 in a direction which runs transversely to the conveying direction B of the printing products 3. Various such formations and devices for their formation will now be explained below with reference to FIGS. 3 to 10.

In FIGS. 3 and 4, formations S', which are to be fed to the winding core 2 and in which the individual printing products 3 are slightly skewed in relation to their conveying direction B, are shown in plan view. This skewing is indicated by the angle $\alpha$. The lateral fold edge 3*b* of each printing product 3 is offset in relation to the fold edge 3*b* of the neighboring product 3 in the direction of the arrow C by the amount a. In this case, the laterally protruding corners 3*c*, 3*d* of the printing products 3 lie on an imaginary line 7 and 8 respectively, which are shown by broken lines and run parallel to the conveying direction B. The direction C, in which the lateral fold edges 3*b* are mutually offset, runs transversely to the conveying direction B and forms with it an angle which is smaller (FIG. 3) or greater (FIG. 4) than 90° by the angle $\alpha$. The formations shown in FIG. 3 and 4 differ only in the direction of the skewing of the products 3 in relation to the conveying direction B.

No inordinate thickening takes place at the side of the roll 6 during winding of an imbricated formation S' according to FIG. 3 or FIG. 4 onto the winding core 2, since the lateral fold edges 3*b* do not all end up on top of one another over their entire length. The present invention enables compact rolls to be formed even with thick, twice-folded printing products 3 without any changing or adapting being necessary during the winding operation. In particular, the present invention enables stable winding of imbricated, multi-sheet, folded printing products without increasing the tensile stress in the winding band or offsetting the band from the center of the roll.

A device for forming the formation shown in FIG. 3 is diagrammatically shown in plan view in FIG. 5. The conveying device conveying the printing products 3 to the winding station 1 and denoted by 9 has a delivery conveyor 10, which is designed as a belt conveyor and to which a second belt conveyor 11 adjoins. Second belt conveyor 11 is skewed in relation to the delivery conveyor 10, so that the conveying direction B of the second belt conveyor 11 forms an acute angle $\alpha$ with the conveying direction A of the delivery conveyor 10. Arranged above the belt conveyor 11 in the initial section of the conveyor 11 is a pressure roller 12, which is seated at one end of a pivotally mounted lever 13. In the region of the end of the delivery conveyor 10, a retaining roller 14 is provided, which is likewise mounted on a pivotally mounted lever 15. Both rollers 12, 14 are freely rotatable, however, it is also possible to drive the rollers 12, 14. The directions of rotation of the rollers 12, 14 are the same as the conveying directions B and A of the belt conveyors 11 and 10 respectively. The distance b between the two rollers 12, 14 is somewhat greater than the length 1 of the printing products 3.

The printing products 3 are fed by the delivery conveyor 10 in an imbricated formation S, in which the lateral fold edges 3*b* of the printing products 3 are aligned with one another in conveying direction A. Upon transfer of the printing products 3 from the delivery conveyor 10 to the belt conveyor 11, they are conveyed further in conveying direction B which, as already mentioned, makes an angle $\alpha$ with the conveying direction A of the delivery conveyor 10. In this case, the offset a, mentioned with reference to FIG. 3, of the fold edges 3*b* of successive printing products 3 arises. The pressure roller 12, brought to bear on the printing products 3 in the region of their lateral fold edge 3*b*, ensures a satisfactory takeover of the printing products by the belt conveyor 11 and thus a correct lateral drawing away of the products 3 arriving on the belt conveyor 11. Under certain circumstances, this pressure roller 12 may be dispensed with, depending on conditions. The retaining roller 14 is preferably provided with an adhesion covering and serves to prevent the next product 3 still resting on the delivery conveyor 10 from being taken along by the preceding printing product 3, already drawn away by the belt conveyor 11. In a satisfactory transfer of the printing products 3 from the belt conveyor 10 onto the belt conveyor 11, these printing products 3 are virtually not turned, so that the leading edges 3*a* in the imbricated formation S' fed by the belt conveyor 11 to the winding core 2 are approximately parallel to the leading edge 3*a* of the printing products 3 fed by the delivery conveyor 10. The conveying speeds of the belt conveyors 10 and 11 are the same, but under certain circumstances may also differ somewhat from each other. The apparatus for forming the imbricated formations S' shown in FIG. 4 corresponds to the device according to FIG. 5, with the modification that the belt conveyor 11 is angled in relation to the delivery conveyor 10 toward the opposite side from that shown in FIG. 5.

The formation S' according to FIGS. 3 and 4 may also be formed by slight turning of the printing products 3 within the fed imbricated formation S. In an apparatus for performing this turning, above the delivery conveyor 10 there would be a freely rotatable or driven conveying roller, the conveying direction of which forms an acute angle, for example the angle $\alpha$, with the conveying direction A of the delivery conveyor 10. This conveying roller would be preferably arranged in such a way that it comes to bear approximately in the center of the products 3. As soon as the printing products arrive in the effective area of this conveying roller, they would be drawn askew by the conveying roller. The guiding away of the products drawn askew can take place in conveying direction A of the delivery conveyor 10 or in the conveying direction of the delivery roller.

A further formation S'' is shown in plan view in FIG. 6 in which the lateral fold edges 3*b* of certain printing products 3 are laterally offset in relation to the lateral fold edges 3*b* of other printing products 3. As shown in FIG. 6, a section 17 of the imbricated formation S'' is offset in relation to the preceding section 16 in the direction of the arrow C' by the amount a'. The offsetting direction C, in this case runs at right angles to the conveying direction B of the imbricated formation S''. Within the sections 16, 17, the printing products 3 are aligned with one another with their lateral fold edges 3*b* in the conveying direction B. This laterally offset section 17 is again adjoined by an offset section 16', which is only indicated in FIG. 6. When the imbricated formation S'' is fed to the winding core 2, certain sections 17 are offset sideways at intervals.

A part of a roll 6 is shown in FIG. 7 which is formed from an imbricated formation S'', according to FIG. 6, wound onto a winding core 2. It is evident from FIG. 7 that the printing products 3 of the sections 17 protrude on the side of the fold edges 3*b* beyond the printing products 3 of the sections 16. Thus, in the case of this exemplary embodiment as well, not all of the lateral fold edges 3*b* end up one on top of the other. The length of the laterally offset sections 17, and accordingly the length of the sections 16, 16', may be chosen such that each winding layer is offset in relation to the neighboring winding layers or a plurality of winding layers are offset in relation to a number of other winding layers. FIG. 7 also shows that the wound winding band 4 separates the various winding layers from one another. In this case, each winding layer is formed only by an imbricated formation S'' which has periodically laterally offset sections 17.

An apparatus is shown in FIG. 8 which is capable of forming the imbricated formation S'' of the type shown in FIG. 6. Arranged between the delivery conveyor 10, designed as belt conveyor, and a belt conveyor 11, which feeds the imbricated formation S'' to the winding core 2, is a displacing device 18, which can be displaced back and forth in the direction of the arrow D. This displacing direction D runs approximately at right angles to the two equi-directional conveying directions A, B of the belt conveyors 10, 11. The displacing device 18 has two endless, driven bands 19, 20 which are passed over deflection rollers (not labelled). The sides 19*a*, 20*a* of the bands 19, 20 running in conveying direction A, B serve as guiding elements for the side edges of the printing products 3 and are arranged at a distance c which corresponds approximately to the width d of the printing products 3. The guiding elements 19*a*, 20*a* are preceded by an in-feed section 19*b*, 20*b*, which converges in conveying direction A, B.

The delivery conveyor 10 delivers the printing products 3 in an imbricated formation S, in which the side edges 3*b* of the printing products 3 are aligned with one another in conveying direction A. If the displacing device 18 is in its left-hand end position, seen in its conveying direction A, B, which position is indicated by dot-dashed lines, the printing products 3 fed by the delivery conveyor 10 run between the guiding elements 19*a*, 20*a* without any offset taking place. If the displacing device 18 is then moved into the right-hand end position, represented by solid lines in FIG. 8, the printing products 3 butt with their leading corner against the in-feed section 19*b* and are displaced by the latter to the right, seen in conveying direction A. The printing products 3 displaced in this way run between the guiding elements 19*a*, 20*a* and are aligned by the latter. The displacing device 18 remains in the right-hand end position for a certain time, during which a section 17 offset by the amount a' is formed. The displacing device 18 is then displaced into the left-hand end position (formation of a section 16) and then moved again into the right-hand end position after a certain time. The length of the individual sections 16, 17 is determined by the frequency of the back and forth movement of the displacing device 18. It is also conceivable to arrange the displacing device in a position of rest centrally to the conveying direction A, B and then to move it out of this position of rest to the left and to the right for forming the sections 16 and 17 respectively. Instead of the circulating bands 19, 20, stationary baffles which each have a guiding element and an in-feed section may also be provided.

Figure 9:
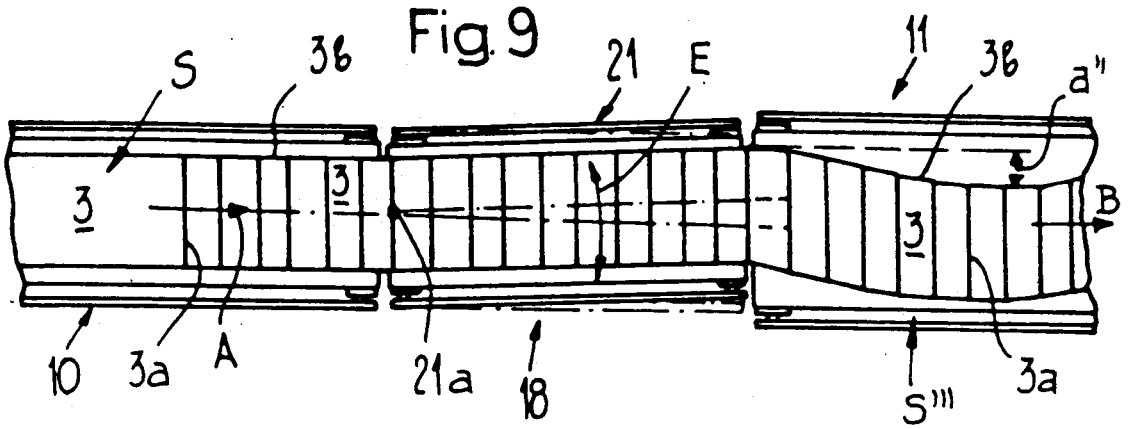

An embodiment similar in operating principle to the apparatus according to FIG. 8 is shown in FIG. 9. In FIGS. 8 and 9, the same reference symbols are used for corresponding parts. In the apparatus according to FIG. 9, the displacing device 18 arranged between the belt conveyors 10 and 11 is formed by a belt conveyor 21, which can be swivelled back and forth in the direction of the arrow E about a swivel axis 21*a* at right angles to its conveying plane. The swivel axis 21*a* is located, in this case, at the end of the belt conveyor 21 facing the delivery conveyor 10. If the belt conveyor 21 in each case stays in its end positions for a certain time, an imbricated formation S'' which corresponds essentially to the imbricated formation according to FIG. 6 is formed. If, however, the belt conveyor 21 is swivelled back and forth continuously, an undulating imbricated formation S''', such as that shown in FIG. 9, is produced. In this imbricated formation S''', the lateral fold edge of each printing product 3 is then offset in relation to the lateral fold edge of the neighboring printing products. The maximum lateral offset is denoted by a'' in FIG. 9.

Figure 10:
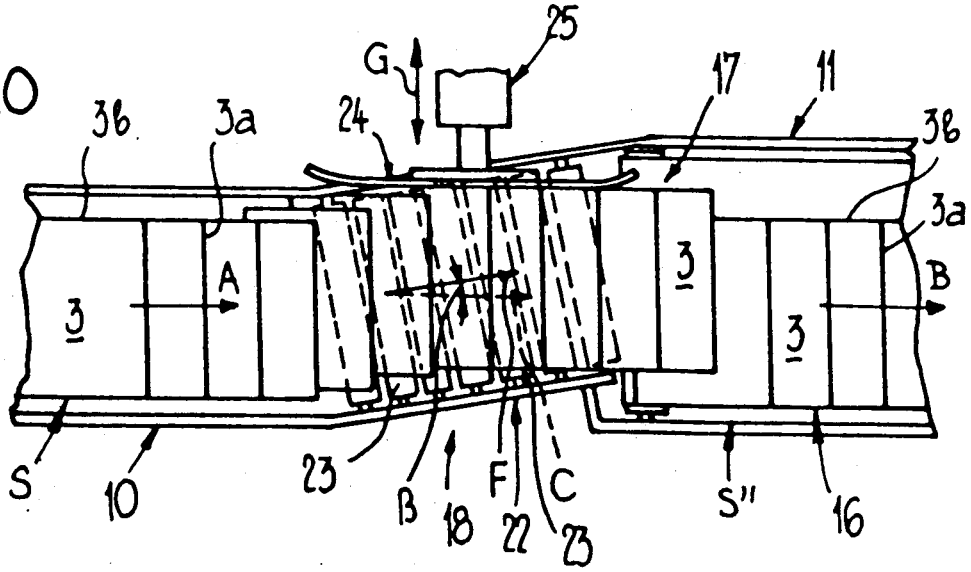

In FIG. 10, a further apparatus is shown which is capable of producing an imbricated formation S'' according to FIG. 6. The same reference symbols are used in FIG. 10 as in FIG. 8 for corresponding parts. In the embodiment according to FIG. 10, arranged between the belt conveyors 10 and 11 is a further conveyor 22, the conveying direction F of which makes an acute angle $\beta$ with the conveying direction A, B of the belt conveyors 10, 11. This conveyor 22 consists of a number of driven rollers 23 arranged mutually parallel. Arranged to the side of this conveyor 22 is a stop rail 24, which runs in conveying direction A, B of the conveyors 10, 11 and can be displaced by means of a displacing mechanism 25 back and forth in the direction of the arrow G, approximately at right angles to the conveying directions A, B mentioned. The roller conveyor 22 conveys the printing products 3 fed by the delivery conveyor 10 sideways toward the stop rail 24, at which the printing products 3 make contact with their lateral fold edge 3*b* and are thereby aligned in conveying direction A, B. The embodiment of FIG. 10 permits a laterally offset section 17 to be formed as long as the stop rail is in its left-hand end position, seen in conveying direction A, B, which position is shown in FIG. 10. If the stop rail 24 is then moved to the right, seen in conveying direction A, B, in which position it is flush with the mutually aligned lateral fold edges 3*b* of the arriving imbricated formation S, no lateral displacement of the printing products takes place, so that sections 16 are formed.

It is also possible to form imbricated formations S'' in which each printing product is offset in relation to the neighboring products 3 in direction C', approximately at right angles to the conveying direction A, B. For forming such an imbricated formation, every other product 3 would have to be laterally offset.

If the printing products 3 wound into a roll 6 in the ways described above are required again for further processing, they are unwound from the roll 6 in a way known per se. Before they are fed to a further processing station, in most cases it will be necessary to reverse the lateral offsetting of the printing products carried out as described above. Since this offsetting is only very slight (about 5 to 15 mm), reversal of the offsetting can take place in a relatively easy way. For example, the unwound imbricated formations may be guided by a side straightening apparatus of a conventional type or transferred to a fixed-cycle device, which has cams which are arranged on circulating drawing members, to engage the trailing edges of the printing products and thereby align them.

An offsetting of the lateral fold edges can be brought about in the above-described manner in the case of imbricated formations made up of printing products other than those shown. The present invention is also applicable to imbricated formations formed from once-folded printing products if the fold edge of these printing products is arranged at the side of the imbricated formation. Finally, it is apparent that it is possible to form the imbricated formations shown in FIGS. 3, 4 and 6 directly, for example at the delivery apparatus of rotary presses. In such a case, there would then not first be an imbricated formation S in which the lateral fold edges of the printing products are aligned with one another in the conveying direction.

What is claimed is:

1. A process for the temporary storage of multi-sheeted, folded printing products, such as newspapers, periodicals and parts thereof, comprising: conveying a series of folded printing products in an imbricated stream together with a winding band in a conveying direction toward a winding core, each printing product overlapping an adjacent printing product in said stream and having a lateral fold edge at a side of said imbricated stream, and winding said imbricated stream of printing products and said band around said winding core, wherein, during said winding, at least some of said printing products have said lateral fold edge slightly offset in relation to the lateral fold edge of an adjacent printing product in a direction which runs transversely to said conveying direction of said printing products.

2. The process according to claim 1, wherein the lateral fold edges of the printing products in said imbricated stream initially all run essentially parallel to the conveying direction and are aligned with one another, and said lateral fold edges are offset by a changing of a position of at least some of the printing products prior to winding on said winding core.

3. The process according to claim 1, wherein said printing products are wound on said winding core in an imbricated formation wherein said printing products are slightly skewed in relation to said conveying direction.

4. The process according to claim 2, wherein, prior to winding, said conveying direction of said imbricated stream is changed.

5. The process according to claim 3, wherein, prior to winding, said conveying direction of said imbricated stream is changed.

6. The process according to claim 2, wherein all of the printing products are turned within said imbricated stream prior to winding.

7. The process according to claim 3, wherein all of the printing products are turned within said imbricated stream prior to winding.

8. The process according to claim 3, wherein laterally protruding corners of said printing products are moved essentially along a straight line which runs parallel to said conveying direction of said printing products.

9. The process according to claim 2, wherein, prior to winding, at least some of the printing products are displaced in relation to other printing products in a direction running approximately at right angles to said conveying direction.

10. The process according to claim 3, wherein, prior to winding, at least some of the printing products are displaced in relation to other printing products in a direction running approximately at right angles to said conveying direction.

11. The process according to claim 9, wherein a number of printing products are displaced periodically.

12. The process according to claim 10, wherein a number of printing products are displaced periodically.

13. The process according to claim 1, wherein said winding core is attached to have a substantially horizontal axis of rotation.

14. In an apparatus for the intermediate storage of multi-sheeted, folded printing products, such as newspapers, periodicals and parts thereof, to which printing products arrive in an imbricated stream with adjacent printing products overlapping one another and having a lateral fold edge at a side of the imbricated stream, said apparatus having a conveying device for feeding the imbricated stream of printing products in a conveying direction to a winding location at which a winding core is rotatably mounted and to which a winding band is connected, which band while running on a side of the imbricated stream facing away from the winding core can be wound onto the winding core together with said imbricated stream of printing products, the improvement comprising: offsetting means for forming a formation of imbricated printing products to be fed to said winding core wherein the lateral fold edge of at least some of the printing products is slightly offset in relation to the lateral fold edge of an adjacent printing product in a direction which runs transversely to the conveying direction of the printing products.

15. The apparatus according to claim 14, wherein the conveying device is a delivery conveyor for feeding an imbricated stream of printing products with the lateral fold edges of all the printing products running essentially parallel to the conveying direction and aligned with one another, wherein said offsetting means includes position changing means for changing the position of at least some of the printing products in relation to other printing products in the imbricated stream.

16. The apparatus according to claim 15, wherein said position changing means comprises a further conveyor which adjoins said delivery conveyor and has a further conveying direction which makes an acute angle with the conveying direction of said delivery conveyor.

17. The apparatus according to claim 16, further comprising a pressure roller arranged above said further conveyor and located in an initial region thereof, said pressure roller being capable of being moved to contact and apply pressure to printing products on said further conveyor.

18. The apparatus according to claim 17, wherein said pressure roller is freely rotatable.

19. The apparatus according to claim 17, wherein said pressure roller is a driven pressure roller.

20. The apparatus according to claim 16, further comprising a retaining element arranged above an end region of said delivery conveyor for contacting printing products on said delivery conveyor.

21. The apparatus according to claim 20, wherein said retaining element is a freely rotatable roller having an adhesion covering.

22. The apparatus according to claim 20, wherein said retaining element is a driven roller having an adhesion covering.

23. The apparatus according to claim 17, further comprising a retaining element arranged above an end region of said delivery conveyor for contacting printing products on said delivery conveyor.

24. The apparatus according to claim 23, wherein said pressure element and said retaining element are separated by a distance greater than a length of a printing product.

25. The apparatus according to claim 15, wherein said position changing means includes a conveying element which has a further conveying direction which makes an acute angle with the conveying direction of the delivery conveyor and which turns the printing products when it acts on them.

26. The apparatus according to claim 15, wherein said position changing means includes a further conveyor having essentially the same conveying direction as the delivery conveyor and a displacing device arranged between said delivery conveyor and said further conveyor, said displacing device being movable, back and forth, transversely approximately at right angles to the conveying direction of the delivery conveyor.

27. The apparatus according to claim 26, wherein said displacing device includes two guide elements arranged at a distance from each other which corresponds approximately to a width of the printing products, said guiding elements having at an end facing said delivery conveyor an in-feed section converging in said conveying direction.

28. The apparatus according to claim 27, wherein said guiding elements are circulating sections of driven bands.

29. The apparatus according to claim 26, wherein said displacing device includes a third conveyor, capable of being swivelled back and forth about an axis running at right angles to a conveying plane of said displacing device and located at an end of said third conveyor facing the delivery conveyor.

30. The apparatus according to claim 26, wherein said displacing device includes a third conveyor located between said delivery conveyor and said further conveyor and having a conveying direction which forms an acute angle with the conveying direction of the delivery conveyor, and a stop element located in a region of said third conveyor, said stop element being adjustably movable at approximately right angles to the conveying direction of said delivery conveyor and extending approximately parallel to said conveying direction of said delivery conveyor wherein said third conveyor conveys printing products toward the stop element.

31. The apparatus according to claim 30, wherein said third conveyor is a plurality of mutually parallel, driven rollers.

32. The apparatus according to claim 14, wherein said offsetting means forms an imbricated formation wherein the printing products are slightly skewed in relation to the conveying direction.

33. The apparatus according to claim 14, wherein said winding core is rotatably mounted so as to have a substantially horizontal axis of rotation.

* * * * *